United States Patent [19]

Garin et al.

[11] 4,139,913

[45] Feb. 20, 1979

[54] EXTENSIBLE MATERNITY SLACKS

[76] Inventors: Jacques Garin, 126, avenue Gambetta; Claude Orenstenne, 283 rue des Pyrénéés, both of Paris, France, 75020

[21] Appl. No.: 806,297

[22] Filed: Jun. 13, 1977

[30] Foreign Application Priority Data

May 25, 1977 [FR] France ..... 77 15952

[51] Int. Cl.[2] ..... A41F 9/02

[52] U.S. Cl. ..... 2/237; 2/221

[58] Field of Search ..... 2/221, 237, 76, 211

[56] References Cited

U.S. PATENT DOCUMENTS

| | | | |
|---|---|---|---|
| 1,174,976 | 3/1916 | Gaines | 2/221 |
| 2,526,813 | 10/1950 | Fanning | 2/237 |

FOREIGN PATENT DOCUMENTS

| | | | |
|---|---|---|---|
| 118227 | 3/1944 | Australia | 2/221 |
| 77566 | 5/1954 | Denmark | 2/221 |
| 841887 | 6/1952 | Fed. Rep. of Germany | 2/221 |
| 818934 | 8/1959 | United Kingdom | 2/221 |
| 960159 | 6/1964 | United Kingdom | 2/221 |
| 1035643 | 7/1966 | United Kingdom | 2/221 |

*Primary Examiner*—H. Hampton Hunter
*Attorney, Agent, or Firm*—George H. Mitchell, Jr.

[57] ABSTRACT

The invention relates to extensible maternity slacks having a front flap adapted to be joined to the edge of a rear flap by a button-hole co-operating with a plurality of buttons, the front flap further comprising on its upper edge a waist-band containing a reinforcing elastic which comprises, in known manner, a succession of regularly spaced apart median button-holes, so that one of the button-holes, located at the side edges, is adapted to co-operate with a button located on the side of the said front flap, substantially where the said waist-band opens out, the judicious choice of the button-hole, fitted on the button, enabling the tension of said flap to be adjusted at its upper edge.

4 Claims, 9 Drawing Figures

EXTENSIBLE MATERNITY SLACKS

The present invention relates to ladies' slacks, and more particularly, to slacks which stretch at the waist and in the pelvic region. Such slacks are more especially intended for pregnant women, who can alter the size of the slacks as the pregnancy develops.

In this way, the slacks may be worn during the whole pregnancy since they are adapted to the development of the wearer's morphology, the dimensions of the slacks, in the pelvic region, being adapted to the increase in the waist measurement and the increase in volume of the abdomen as the birth approaches.

So-called maternity slacks of this type are known which comprise various systems for altering the size of the garment; this adaptation is generally obtained by complex means which are only partly satisfactory.

Imperatives which are often contradictory must, in fact, be united in slacks of this type.

On the one hand, the comfort of the wearer who, during this difficult period, not surprisingly, desires slacks which do not hinder her movements and which are agreeable to wear.

However, at the same time, the wearer does not wish to sacrifice taste and smartness and generally seeks slacks which are no different from slacks of classic cut, thus allowing her not to make herself conspicuous; the pregnant woman often seeks slacks, or clothes in general, which, without sacrificing comfort, do not emphasize her state, and even hide it, by giving the appearance and silhouette which differs the least possible from her usual figure.

Finally, it is obvious that the slacks must, at the same time, not go against rules of hygiene and health, which could harm the development of the unborn baby.

Known maternity slacks are not well adapted to these various imperatives and slacks are generally known which are similar to slacks of classical cut and system of fastening which may be worn during the first months of pregnancy but which must be discarded in the last months; inversely, slacks are known which are more adapted to be worn during the months towards the end of pregnancy, but these slacks are generally not smart and will not be worn during the first months of pregnancy.

This means that the pregnant woman is obliged to change her wardrobe, the clothes thus having been worn only for a few months, and representing unnecessarily high expenses.

It is an object of the invention to remedy these drawbacks and it relates to this end to slacks, particularly maternity slacks, which may be adapted to all the stages of pregnancy, from the beginning to the end, and presenting to this end a particularly developed range of fit, the slacks keeping at all times their impeccable cut and presentation which will satisfy the wearer's desire for smartness. In particular, the slacks are characterized by fastening and adaptation means which allow them to increase in size from the beginning of pregnancy to the last day, without alteration to the structure thereof.

To this end, the invention relates to slacks of the type in which a front flap is fastened to a rear flap by buttoning at the sides, the front flap and the rear flap being separated laterally by a slit enabling the front flap to overlap the edge of the rear flap, wherein on the one hand, each side of the front flap may be fastened to the edge of the rear flap by a button-hole co-operating with a plurality of buttons, and on the other hand, the front flap comprises on its upper edge a waist-band containing reinforcing elastic, said elastic comprising, in known manner, a succession of regularly spaced apart median button-holes so that one of the button-holes, located at the side edges, is adapted to co-operate with a button located on the side of said front flap, substantially where said waist-band opens out, the judicious choice of the button-hole, fitted on the button, enabling the tension of said flap to be adjusted at its upper edge.

The front flap preferably comprises a button-hole substantially in the angle formed by its upper edge and the side edge, which button-hole is adapted to co-operate alternately with a plurality of suitably spaced apart buttons aligned on the rear flap, the waist size being adjusted by the judicious choice of the button to be inserted in said button-hole.

Under these conditions, it is appreciated that the slacks according to the invention allow a particularly supple and regular adjustment of the waist and volume of the pelvic region; in fact, two suitably spaced apart buttons may be provided on the rear flap which are adapted to co-operate with a single button-hole located on the front flap.

Consequently, each of these two buttons corresponds to a possibility of use defining a particular waist size and volume.

By fastening the button-hole on the rear button, the smaller waist size is obtained, corresponding to the use of the slacks during the first months of pregnancy; later, when this first position is too tight, the wearer may then fasten the button-hole on the front button, thus sufficiently increasing the size and volume of the slacks for the pelvic region.

These two possibilities of use are sufficient to enable the slacks to be altered in size during the whole of the pregnancy.

According to the invention, the device of the button-hole co-operating with a plurality of buttons is combined with the device constituted by the insertion of the elastic in the waist-band along the top edge of the front flap.

In fact, the single button-hole co-operating alternately and successively with one of the two buttons constitutes a system of adjustment enabling two ranges of fit to be defined, viz. normal and large.

However, within each of these ranges there is a more precise adjustment using the elastic, as will be described hereinbelow.

According to a further feature of the invention, the front flap comprises, at the side slit separating it from the rear flap, a slightly convex vertical edge, facing rearwards, this form allowing an adaptation without creases of this edge successively to one and the other of the buttons of the rear flap.

According to yet a further feature of the invention, the front flap and the rear flap, separated by a side slit, enabling the front flap to overlap on the rear flap, are connected by a horizontal seam which defines the bottom of said slit, beneath which the two flaps are joined by a vertical seam forming the side seam of the slacks, as is known.

According to another feature of the invention, the rear flap comprises a reinforcing band along the upper edge of the slacks and overstitched along two horizontal lines of stitching, following the upper edge of this band and its lower edge, respectively, thus defining a reinforcement of the waist on the rear flap, said band being extended vertically at the slit to join the transverse stitching which defines the bottom of said slit.

The invention will be more readily understood on reading the following description with reference to the accompanying drawings, in which.

Figure 2:
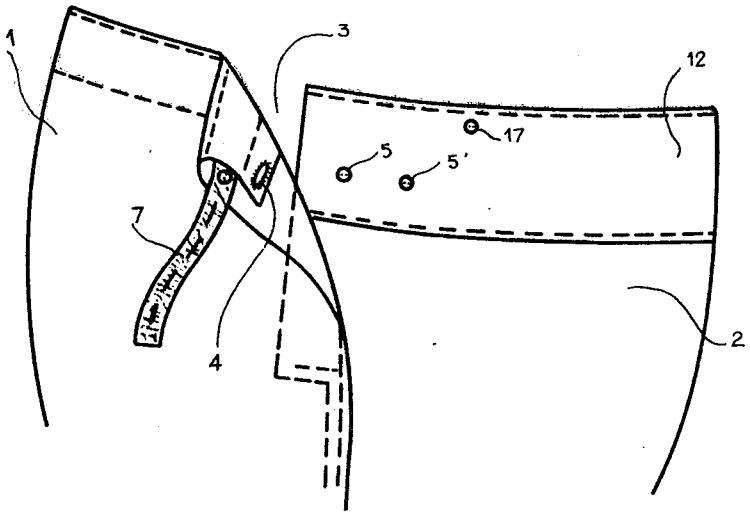
FIG. 2 is a perspective view showing the details of the side fastening device of said slacks.
Figure 1:
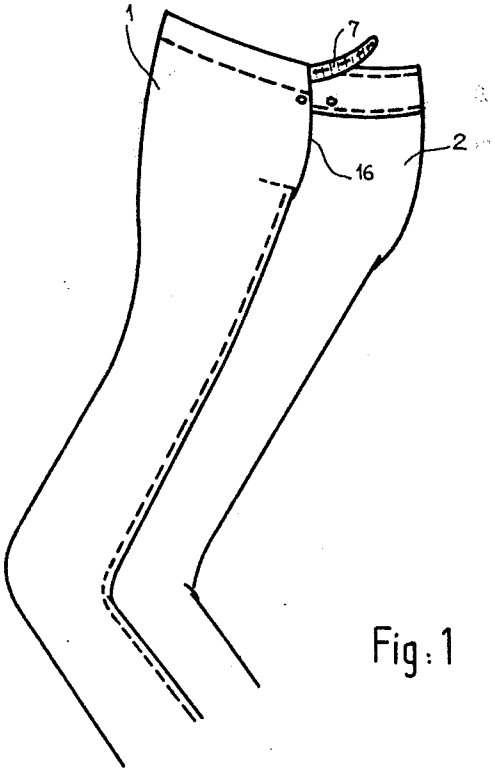
FIG. 1 is a side elevation view of the slacks according to the invention.
Figure 5:
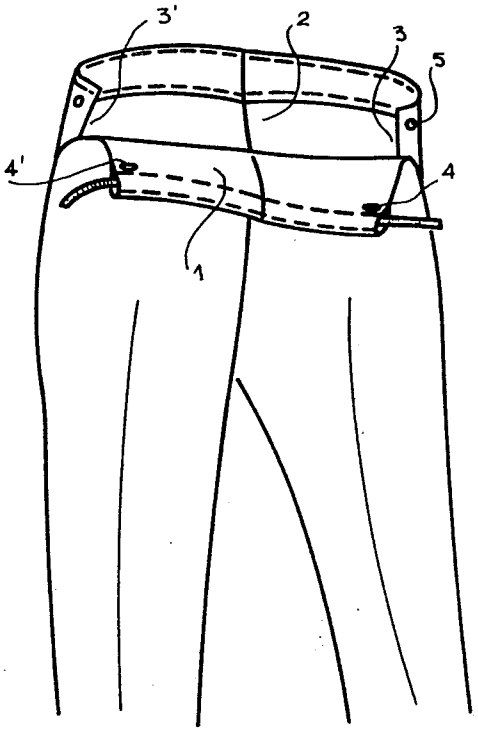
FIG. 5 shows the same slacks from the front, with the front flap slightly folded down in open position.

Referring now to the drawings, the Figures show that the slacks according to the invention comprise a front flap 1, joined to a rear flap 2 and closed by a side slit 3, 3' on each side.

Each of the front and rear flaps is itself made from sewn pieces known per se.

According to the invention, the front flap overlaps the rear flap and is fastened thereto at the side slits, using an original fastening system constituted by a single button-hole located on the side edge of the front flap, and not far from the upper edge, i.e. substantially in the angle made by the upper edge of the front flap and its side edge at the slit; this single button-hole 4, 4' co-operates with a plurality of buttons 5, 5' suitably spaced apart along a substantially horizontal line, on the rear flap.

Figure 7:
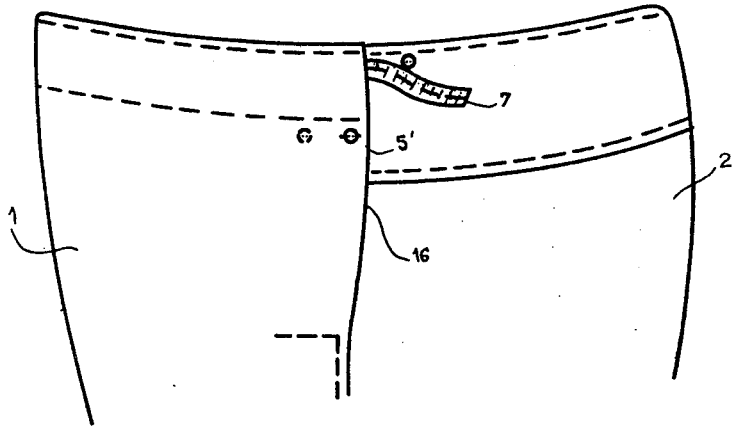
FIG. 7 is a side view of the slacks in their tightest fitting.
Figure 8:
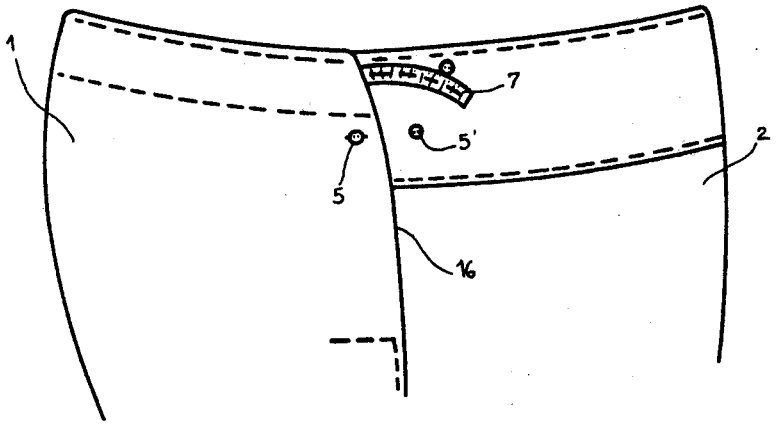
FIG. 8 shows a view of the slacks in a wider fitting.

FIGS. 7 and 8 show that the front flap 1 may be fastened on the rear flap by fitting button-hole 4 on the rear button 5' (FIG. 7), this corresponding to the tightest fitting.

Later, with the development of the size and volume of the pelvic region of the wearer, the button-hole 4 may be positioned on the front button 5, this determining a wider fitting.

The slacks may thus be adjusted to two ranges of dimensions corresponding to the spacing between buttons 5 and 5' multiplied by two.

An intermediate position may also be used by fitting button-hole 4 on rear button 5' on one side, whilst, on the other side, button-hole 4' would be fitted on front button 5, this allowing an intermediate fit between the volumes defined by FIGS. 7 and 8 and an increase in the size corresponding to the space between the two buttons 5 and 5'.

In practical terms, the spacing between buttons 5 and 5' will be between 3 and 10 cm, and preferably of the order of 5 cm.

In accordance with the invention, a fine, more precise adjustment device co-operates with the two-button device described hereinabove.

To this end, the upper edge of the front flap 1 comprises an internal waist-band 6 in which is passed an elastic 7 provided with a succession of median button-holes 8, 8' . . .

This internal elastic enables the front flap to be adjusted and tensioned.

To this end, each side of the front flap comprises on its side edge where the waist-band 6 emerges at 9, a button 10 which may co-operate with one of the button-holes 8, 8' . . . in the elastic 7.

The tension of the front flap 1 may thus easily be adjusted by suitably choosing the button-hole 8, 8' . . . in the elastic 7, on each side of said flap.

Figure 4:
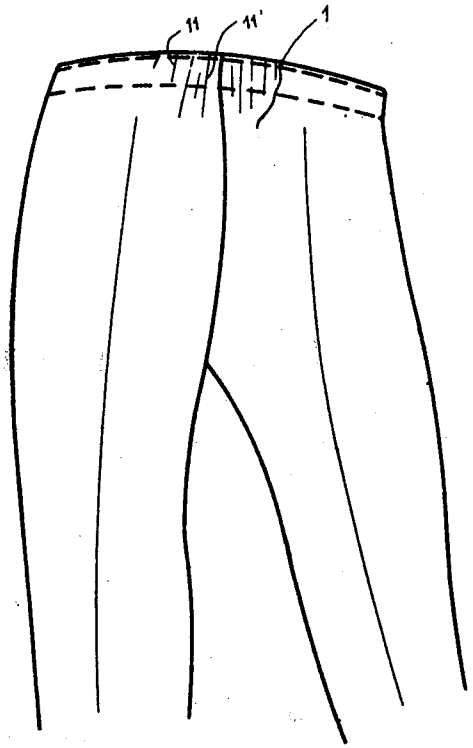
FIG. 4 is a perspective view of the slacks seen from the front.
Figure 3:
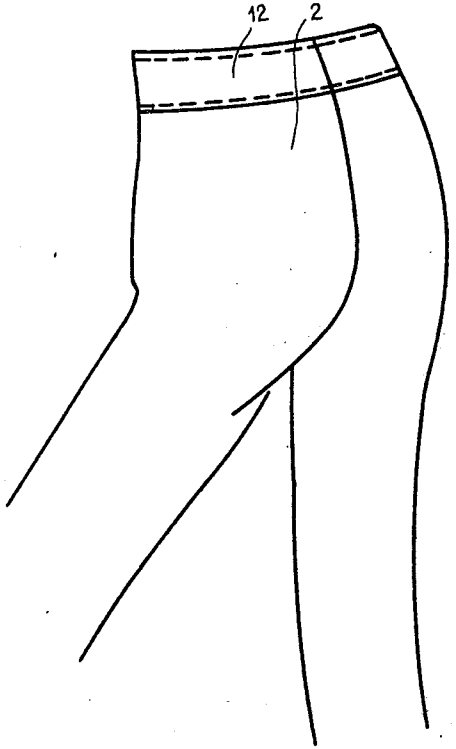
FIG. 3 is a three-quarter rear view in perspective of the slacks.

When the front flap is tight, corresponding to a narrow waist at the beginning of use, small gathers 11, 11' are formed (FIG. 4) on the front of the front flap, thus enabling the slacks to be adapted to an even less developed size.

As the waist and pelvic region enlarge, the wearer simply has to change the button-hole in the elastic 7 which was engaged on button 10 on each side, thus releasing the tension of the front flap and allowing a fine and regular increase in the waist size; this may be effected without changing the position of the button-hole 4 on rear button 5'.

There arrives a moment when the action on the tightening of the front flap by the elastic 7 is no longer sufficient to allow adaptation; the wearer will then use the system of adjustment constituted by the button-hole 4 and the two buttons 5, 5', by modifying the fastening and using the front button 5 instead of the rear button 5', this considerably increasing the size of the waist; however, the wearer will simultaneously tighten the front flap by using the elastic 7 and its own system of buttons and button-holes.

As the size and volume of the pelvic region increases, the changing of the button-holes in the elastic 7 will then allow a further increase, week by week, in the waist size and an adaptation of the size of the slacks to the wide fittings corresponding to the use of button 17.

Figure 6:
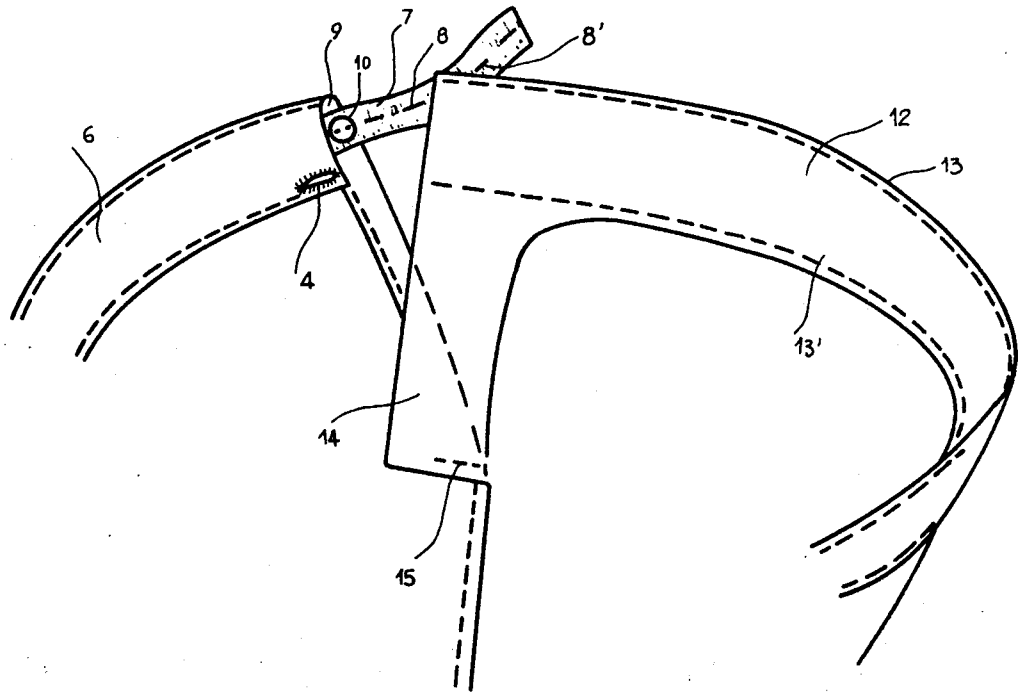
FIG. 6 is a detailed view of the inside of the side slit and fastening means.

FIG. 6 shows that the rear flap 2 internally comprises a reinforcing band 12 along the top horizontal edge thereof, joined to the rear flap by overstitching 13, 13', thus ensuring a reinforced rear waist-band.

This rear band 12 extends vertically at 14 to join a horizontal stop seam 15.

This seam 15 marks the bottom of the side slits 3 and 3' separating the front and rear flaps on each side. It allows the correct positioning of part 14 and avoids gaping thereof or its emerging from behind the front flap, when said latter is in position of closure, overlapping the rear flap.

It will also be noted that the edge 16 of the front flap at the slit follows a curvilinear contour, slightly convex to the rear, this enabling it to take the two positions shown in FIGS. 7 and 8 corresponding to the co-operation of button-hole 4 with the rear button 5' or front button 5, respectively.

Figure 9:
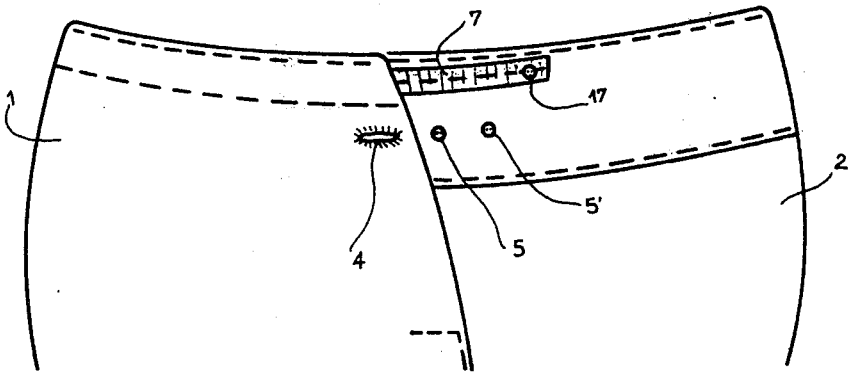
FIG. 9 shows a view of the slacks in their widest fitting.

Finally, FIG. 9 shows the ultimate position corresponding to a maximum extension of the slacks and according to which the button-hole 4 is no longer engaged either on button 5 or button 5' and is, therefore, free, which allows a considerable increase in the size of the slacks.

In this last position, the front flap 1 is joined to the rear flap 2 by the elastic 7, of which one of the last median button-holes, 8, is fitted on a button 17 suitably positioned on the upper edge of the rear flap.

There again, the choice of button-hole 8, 8' in the elastic 7 enables the slacks to be further adjusted to accommodate the final increase in size during the last weeks of pregnancy.

What is claimed is:

1. Slacks, particularly maternity slacks, of the type comprising a front flap and a rear flap to be adjustably joined to the front by buttoning at each side, the front flap and rear flap being separated by a vertical slit at each side enabling the lateral ends of the front flap to overlap the respective ends of the rear flap, wherein:

a. each end of the front flap includes one button-hole and each end of the rear flap includes a horizontal row of first buttons to selectively engage with the button-hole on the corresponding end of the front flap to provide a first adjustment of the size of the waist of the slacks as a whole;

b. the front flap also including at its upper margin a waist-band containing therein an elongated horizontal elastic strip provided with a succession of regularly spaced apart medial button-holes;

c. said front flap also including a fastening button at each end for selective engagement with one of said medial button-holes in the elastic strip for adjusting the tension of the upper margin of the front flap;

d. said rear flap also including at least one further fastening button at each end for selective engagement with another one of said medial button-holes in the elastic strip to provide a second adjustment of the size of the waist of the slacks as a whole.

2. Slacks as recited in claim 1, wherein the respective end margins of the front flap are defined by a rearwardly facing convex line to allow successive adjustment of the size of the waist without creasing of the material.

3. Slacks as recited in claim 1, wherein the front flap and rear flap are connected by horizontal seams which define the lower ends of each of said vertical slits, the two flaps being joined to each other below the horizontal seams by respective vertical side seams.

4. Slacks as recited in claim 1, wherein the upper margin of the rear flap includes a reinforcing band defined by a horizontal line of stitching along the upper edge of the rear flap and by another horizontal line of stitching below said first line and extending downwardly at each end to join a line of stitching defining the lower end of each of said slits.

* * * * *